US005226867A

United States Patent [19]

Beal

[11] Patent Number: 5,226,867

[45] Date of Patent: Jul. 13, 1993

[54] EXERCISE MACHINE UTILIZING TORSION RESISTANCE

[76] Inventor: Daniel Beal, 73 Westerly Ter., East Hartford, Conn. 06118

[21] Appl. No.: 903,722

[22] Filed: Jun. 24, 1992

[51] Int. Cl.[5] ..... A63B 21/45

[52] U.S. Cl. ..... 482/127; 482/120

[58] Field of Search ..... 482/120, 127, 114, 115, 482/116, 72

[56] References Cited

U.S. PATENT DOCUMENTS

| | | | |
|---|---|---|---|
| 434,771 | 8/1890 | Dowd | 482/127 |
| 1,867,642 | 7/1932 | Woods . | |
| 1,983,911 | 12/1934 | Luppert | 482/127 |
| 2,951,702 | 9/1960 | Goodwin | 482/127 |
| 3,544,105 | 1/1970 | Latta . | |
| 3,596,907 | 8/1971 | Brighton | 482/120 |
| 3,687,450 | 8/1972 | Schollmeyer . | |
| 4,010,948 | 3/1977 | Deluty | 482/120 |
| 4,114,875 | 9/1978 | Deluty . | |
| 4,135,714 | 1/1979 | Hughes | 482/127 |
| 4,643,420 | 2/1987 | Riley et al. | 482/127 |
| 4,944,511 | 7/1990 | Francis . | |

*Primary Examiner*—Richard J. Apley
*Assistant Examiner*—Lynne A. Reichard
*Attorney, Agent, or Firm*—McCormick, Paulding & Huber

[57] ABSTRACT

A user-manipulated modular exercise machine has individually operable and simultaneously adjustable right and left-hand reel assemblies. Each reel assembly includes a reel, a pull-cord wound on the reel, and a spirally wound spring which applies to the reel a reactive torque of changing magnitude as the reel rotates in response to pulling input force applied to the pull-cord. Each reel assembly has a compensating mechanism for nullifying changes in the magnitude of the reactive torque as the reel rotates and which includes a prewound spiral spring and a belt and cam mechanism for connecting the prewound spring to the reel.

22 Claims, 8 Drawing Sheets

CALF RAISE

SCISSOR

SEATED ROW

SEATED PRESS

BENCH PRESS

EXERCISE MACHINE UTILIZING TORSION RESISTANCE

BACKGROUND OF THE INVENTION

This invention relates in general to exercising apparatus and deals more particularly with an improved compact, user-manipulated exercise machine of the cable type wherein resistive force is provided by a spring mechanism.

It is generally desirable that a workout with a user-manipulated exercise machine provide substantially the same benefits as a workout with free weights. To achieve this goal it is essential that the exercise machine provide a resistive output force of substantially constant magnitude which must be overcome by counterforce applied by the user. This objective is easily achieved in large stationary machines, as, for example, machines of the weight stack type. However, the attainment of this goal has proven elusive in the development of light weight compact exercise machines intended for home use.

Independent exercising of both sides of the body promotes symmetrical development and reduces the magnitude of the resistance force required. Less resistance force is required, because without the stabilizing influence of an interconnecting bar, each arm is able to support significantly less than ½ the load used for barbell exercises. This "dumbbell" approach, when applied to an exercise machine, reduces the magnitude of the resistive output force which the machine is required to produce, thereby enabling reduction in the size and weight of the machine.

Accordingly, it is the general aim of the invention to provide an improved durable, lightweight, compact exercise machine of the cable type, which includes cable wound on a reel and provides a force output of substantially constant magnitude both in the cable extension and cable retraction modes. Another aim of the invention to provide a machine having two independently operably, simultaneously adjustable force outputs which may be used in the performance of a wide variety of exercise in standing, sitting, rowing and reclining positions. A further aim of the invention is to incorporate in an exercise machine common, inexpensive springs as the resistive load, which springs historically have been unsuitable for this purpose due to their linearly increasing (non-constant) output force in the direction which draws cable from the reel.

SUMMARY OF THE INVENTION

An exercise machine has at least one reel assembly which includes a reel supported for rotation about a reel axis in one direction of rotation and in another direction of rotation opposite the one direction. A flexible cable or pull-cord wound on the reel rotates the reel in response to pulling input force applied to the cable. Reactive torque is applied to the reel by a main reaction spring which is wound tighter in response to rotation of the reel. This winding of the spring results in a torque which increases in magnitude at a rate expressed as the spring constant causing the required pulling force to increase linearly with the length of cord drawn from the reel. In accordance with the invention at least one compensating mechanism is provided for nullifying the effect of the changes in reactive torque as the reel rotates and includes a preloaded compensating spring and coupling means connecting the compensating spring to the reel for applying compensating torque to the reel and continuously adjusting the magnitude of the compensating torque as the reel rotates in response to pulling input force applied to the pull-cord thereby enabling rotation of the reel in response to pulling input force of substantially constant magnitude.

DETAILED DESCRIPTION OF PREFERRED EMBODIMENTS

Figure 1:
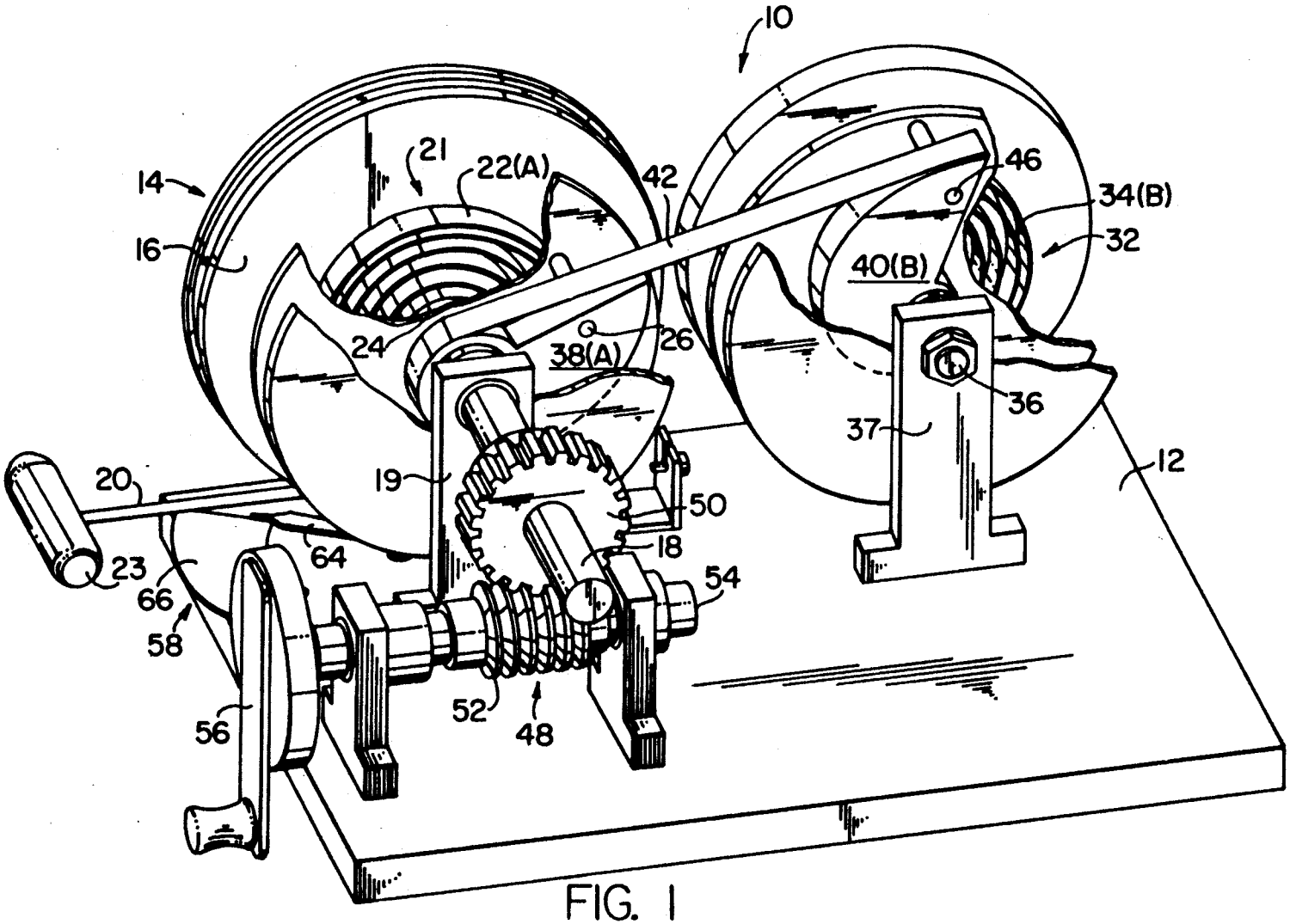
FIG. 1 is a perspective view of an apparatus embodying the present invention.
Figures 2, 3:
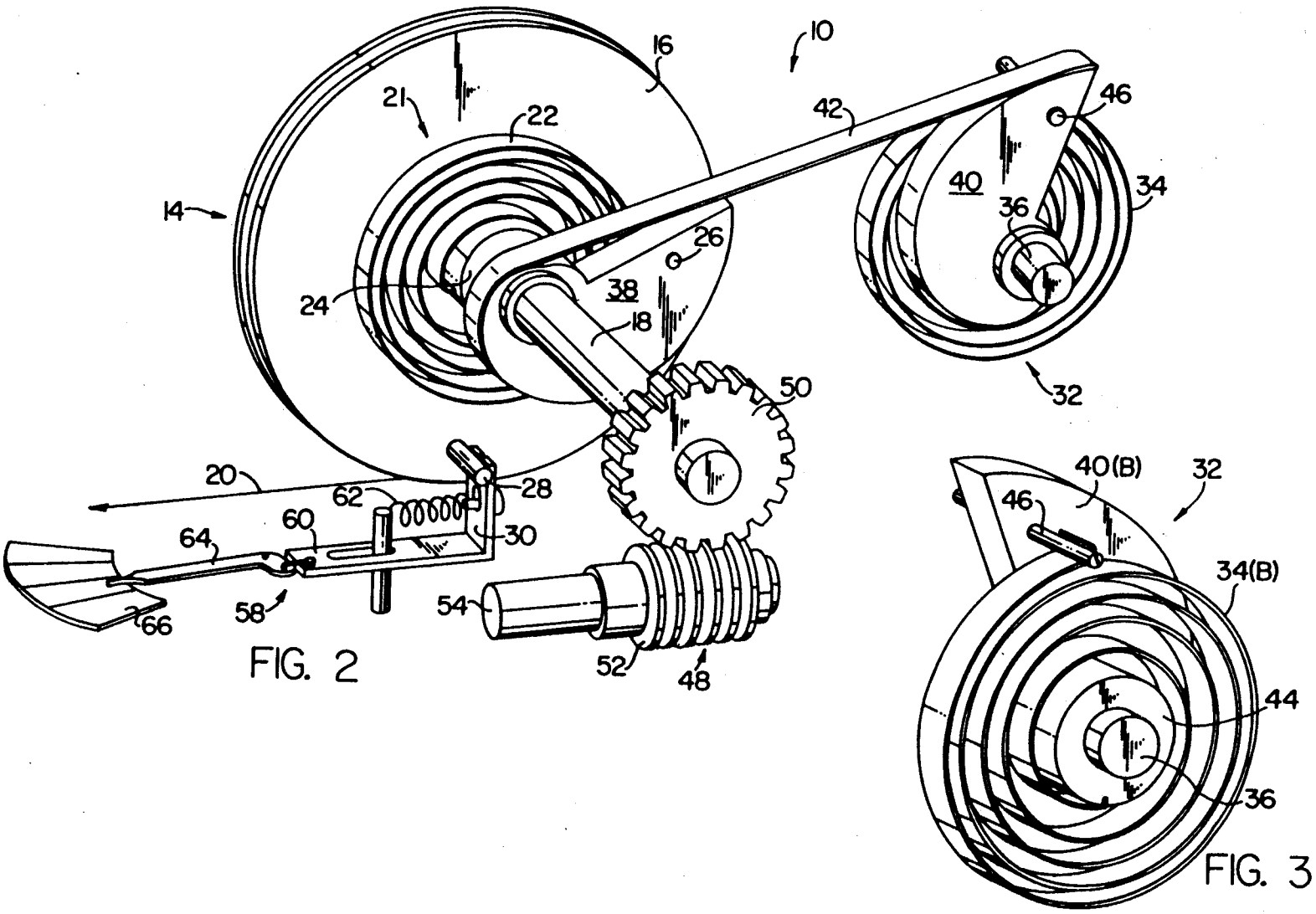
FIG. 2 is a somewhat schematic perspective view of the apparatus of FIG. 1.
FIG. 3 is a perspective view of the reverse side of the compensating spring and associated belt cam shown in FIG. 2.

Turning now to the drawings and referring first particularly to FIGS. 1–3, an apparatus embodying the present invention and illustrating the essential operational principles of the invention is indicated generally by the reference numeral 10. As oriented in FIGS. 1 and 2 the apparatus 10 has a mounting base or frame 12 and an output reel assembly, indicated generally at 14, which includes an output reel 16 journalled for rotation in one direction and in another direction opposite the one direction on and relative to an output shaft or main shaft 18. The main shaft is mounted on shaft support members 19, 19 attached to the base 12 and journalled to permit rotation of the shaft 18. However, the shaft 18 is releasably retained against rotation relative to the frame for a purpose which will be hereinafter evident. A flexible member 20 which preferably comprises a cable or pull-cord has a handle 23 at its free end and is wound on the reel 16 for rotating the reel in clockwise direction in response to pulling force applied to the handle 23. Reactive torque to resist clockwise rotation of the reel is applied to the reel 16 by a spring reaction mechanism, indicated generally at 21, which includes a spirally wound spring 22 of the clock spring or hairspring type wound in clockwise direction about the main shaft 18.

The inner end of the main spring 22 (spring A) is anchored in fixed position to a main spring arbor 24 received on and keyed or otherwise secured in fixed position to the main shaft 18. A reverse loop formed at the outer end of the main spring engages a unitizing pin 26 which projects from the reel 16 causing the main spring 22 to exert counterclockwise biasing torque upon the reel 16. A stop pin 28 projects from the reel 16 for engaging an abutment surface 30 (FIG. 2) to limit counterclockwise rotation of the reel. In the system hereinbefore described the magnitude of the pulling input force required to extend the pull-cord 20 increases as the linear displacement or extent of the pull-cord increases in the pulling direction due to the spring constant of the main spring 22 which is wound by the applied pulling force, thereby producing an output force which increases in magnitude as pulling input force is applied to extend the pull-cord.

In accordance with the present invention, the machine 10 has a spring compensating mechanism for effectively nullifying increases in the magnitude of the reactive torque applied to the reel 16 by the main spring 22 to convert the variable output force of the machine to a constant output force, whereby the pull-cord or cable 20 may be extended by and retracted against an applied force of substantially constant magnitude.

The compensating mechanism, indicated generally at 32, includes a preloaded or prewound compensating spring 34 of the clock spring type (spring B) supported on and wound in counterclockwise direction about a secondary support shaft 36 which is axially parallel to the main shaft 18. The secondary support shaft is mounted on shaft hangers 37, 37 attached in fixed position to the base and is secured against axial rotation relative to the base 12. The compensating mechanism 32 further comprises a pair of belt cams, which include a main spring cam 38 (cam A) and a compensating spring cam 40 (cam B), and a flexible element or belt 42 which connects the belt cams and operably engages the camming surfaces of the cams. The compensating spring cam 40 is journalled for rotation on and relative to the secondary shaft 36. The inner end of the compensating spring 34 is connected in fixed position to a compensating spring arbor 44 mounted in fixed position on the secondary shaft 36, as best shown in FIG. 3. A reverse loop formed on the outer end of the compensating spring 34 engages a unitizing pin 46 mounted on the compensating spring cam 40, substantially as shown in FIG. 3, causing the prewound compensating spring 34 to bias the cam 40 in clockwise direction, as it appears in FIGS. 1 and 2. The main spring cam 38 is similarly journalled for rotation on and relative to the main shaft 18 and is engaged by a unitizing pin 26 which couples it to the main spring and to the output reel 16 to rotate with the output reel.

The preloaded compensating spring 34 is spirally wound about the axis of the secondary shaft 36 in a winding direction opposite to the winding direction of the main spring 22, maintains the flexible belt 42 in tension, and acts through the cams 40 and 38 and the belt 42 to transfer torque of variable magnitude to the output reel 16 to counteract changes in the reactive torque applied to the output reel by the main spring. The counterclockwise reactive torque applied to the output reel 16 by the main spring 22 at all times exceeds the clockwise compensating torque applied to the output reel by the compensating mechanism 32, thereby enabling the stop pin 28 to cooperate with the abutment surface 30 to prevent the output reel 16 from rotating and the main spring from unwinding at its outer end so that the system remains in equilibrium in the absence of an applied input force.

Preferably, and as shown, the apparatus 10 has an adjusting mechanism for varying the output load of the apparatus. In the illustrated embodiment 10 the adjusting mechanism, indicated generally at 48, comprises a reversible worm gear mechanism. More specifically, the adjustment mechanism 48 comprises a worm gear 50 mounted in fixed position on the main shaft 16 and a worm 52 meshing with the worm gear 50 and mounted on a drive shaft 54 supported for rotation relative to the support base by shaft support members mounted in fixed position on the base. A manually operable crank 56 (FIG. 1) is secured to the outer end of the shaft 54. Manual rotation of the crank 56 in one or an opposite direction operates the worm gear mechanism to wind or unwind the main spring 22 thereby increasing or decreasing the reactive spring force applied to the system by the reaction mechanism 21. The "self-locking" worm gear mechanism 48 releasably retains the main shaft 16 against rotation relative to the base 12 to prevent unwinding of the main spring 22 at its inner end.

The illustrated machine 10 also has a load readout device, designated generally by the numeral 58, for indicating the machine output load. The load readout device may take various forms, however, the illustrated device, best shown in FIG. 2, includes a generally L-shaped scale bracket 60 supported for rectilinear movement in one and an opposite direction relative to the base 12 and biased in one direction by a spring 62. One leg of the bracket 60 is disposed in the path of the reel stop pin 28 and defines the abutment surface 30 which limits rotation of the reel 16 in counterclockwise direction, as it appears in FIGS. 1 and 2. As the output load of the machine 10 is varied by manipulating the adjustment mechanism 48 the biasing force exerted by the reel stop pin 28 upon the bracket 60 increases or decreases causing movement of the bracket and corresponding movement of an associated pivoted pointer 64 relative to a fixed calibrated scale 66 to indicate the adjusted output load of the machine 10 when the apparatus is at rest.

Further referring to FIGS. 1 and 2, when pulling input force of sufficient magnitude is applied to the cable 20, the output reel 16 rotates in clockwise direction winding the main spring 22 and causing corresponding rotation of the main spring cam 38 connected to the output reel. As the main spring cam 38 rotates in clockwise direction the compensating spring cam 40 simultaneously rotates in the same direction in response to the clockwise torque applied to the compensating spring cam 40 by the preloaded compensating spring 34 as it unwinds or unloads in the clockwise direction. The output torque applied to the compensating spring cam 40 by the unwinding compensating spring 34 is transferred by the compensating spring cam 40 and the belt 42 to and through the main spring cam 38 to the output reel 16.

The geometry of the cams 38 and 40 is designed so that the clockwise torque transferred from the compensating mechanism 32 to the output reel 16 increases as the compensating spring 34 unwinds to substantially nullify increases in resistive torque applied to the output reel 16 by winding of the main spring 22 in response to clockwise rotation of the output reel 16.

When pulling input force is applied to the cable 20 the user experiences the initial net torque delivered by the mechanism as displayed by the load readout device 58. Additional rotation of the output reel 16 winds the mainspring (A) tighter and by a linear relationship increases its torque.

$$TorA = KAxNA$$

Where

KA = spring constant ft.lbs./turn

NA = turns on the main spring

At the same time, the compensating torque provided by the compensating spring 34 offsets the increasing torque of the main spring 22 allowing the user to experience an essentially constant force over the full range of motion of the device in both the cord extension and retraction modes. The full range of motion is limited to about 0.75 turns. Desired output extension of the pull-cord is provided by sizing the output reel in accordance with the relationship.

$$RP = EX/(2\pi x.75)$$

Where

EX = cord extension-inches

RP = Output Reel pitch radius-inches

The net output load of the device is:

$$L = TorN/RP - lbs.$$

Where

TorN = net torque at the output reel-inch lbs.

RP is the radius of the output reel-inches

OPERATING PROFILES

The manner in which torque is transferred from the compensating spring 34 to the reel 16 is determined by the geometry of the cam and belt mechanism.

The shape of the cam is given by the relationship $$R^2 = \frac{9(NBi \times Ri^2 + dN \times R)}{Nbi - DN}$$

Where

R = cam radius

NBi = preload of compensating spring in number of turns dN = location in turns $$Ri = \frac{dNm + (dNm^2 + 4NBi\,(NBi - dNm)^{0.5}}{2NBi}$$

dNm = maximum rotation of cam

Figure 4:
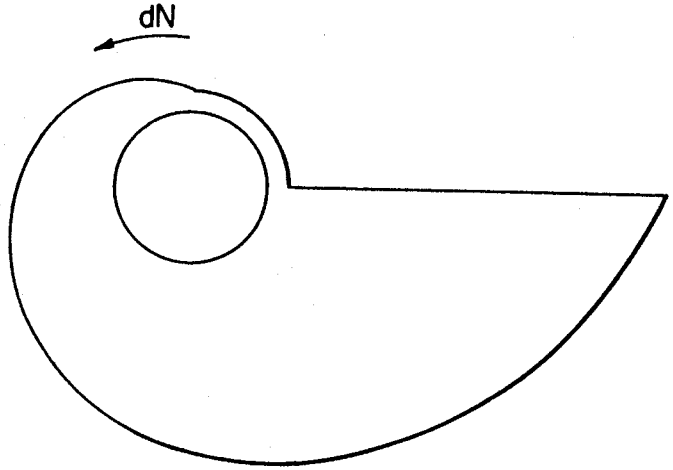
FIG. 4 is a diagrammatic illustration of a compensating spring mechanism cam designed for an exercise machine.

Nbi and dNm are optimized for specific applications. FIG. 4 shows the resulting cam shape designed for an exercise machine.

Figure 5:
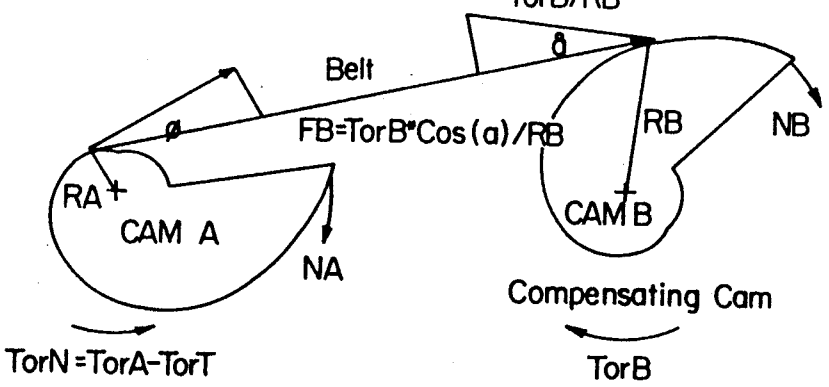

Referring to the cam/belt geometry shown in FIG. 5, clockwise rotation of cam A (NA) pays out belt to Cam B permitting the compensating spring B to unwind NB turns. Force generated in the belt (FB) is given by:

$$FB = TorB\ Cos(å)/RB$$

Where

TorB = Spring B torque TorB = KB (NBi − NB)

NBi = Spring B preload, turns

KB = Spring B spring constant ft.-lb./turn

å = Belt/Cam B contact angle

RB = Local Cam B radius

Similarly, the torque transferred to the reel 16 is:

$$TorT = FB\ RA\ Cos(\phi)$$

Where $\phi$ = Belt/Cam A contact angle

RA = local Cam A radius then

TorT = TorB (RA Cos(å) Cos($\phi$)/RB)

The net output Torque of the device is:

$$TorN = TorA - TorT$$

Figure 6:
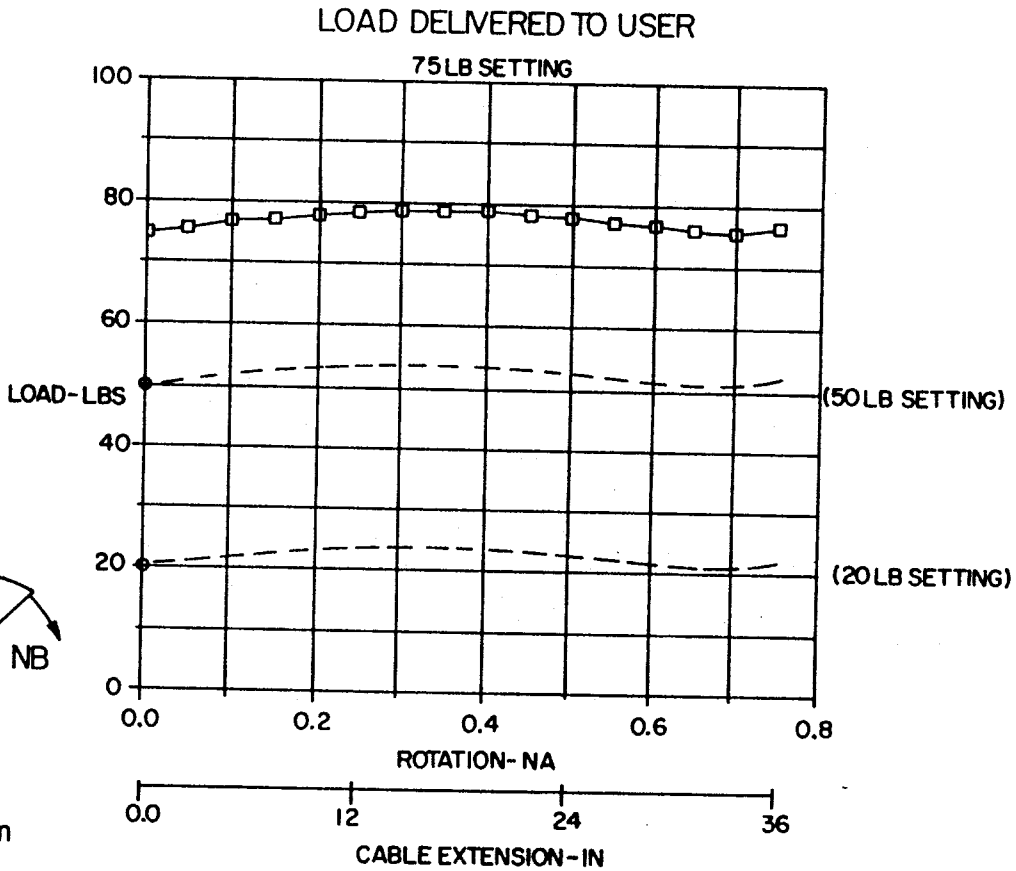
FIG. 6 is a graphic illustration of machine output profile.

The relative motions of Cams A and B and the Belt-/Cam contact angles were determined experimentally. This experimental data has been applied to the design of an exercise machine of a type hereinafter described delivering two independent 75 lb. loads to each of two independently operable output reels (right and left hand). A cable extension of 36 inches has been assumed which determines an output pulley radius of 7.6 inches. The net load delivered to the user is shown in FIG. 6. The shape of the output load profile is a characteristic of this design and is typical for any initial load setting selected by the user. Sample profiles for 20 lb. and 50 lb. settings are also shown in FIG. 6.

Figure 8:
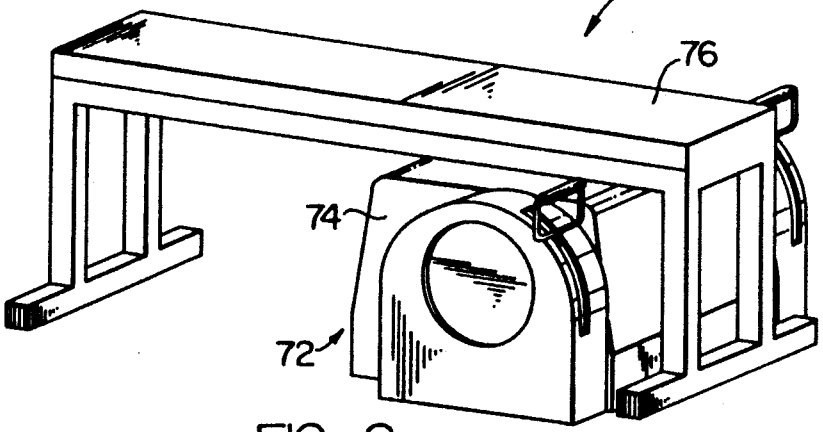
FIG. 8 is a perspective view of the machine of FIG. 7 shown set up for the performance of an exercise in recline position.
Figure 7:
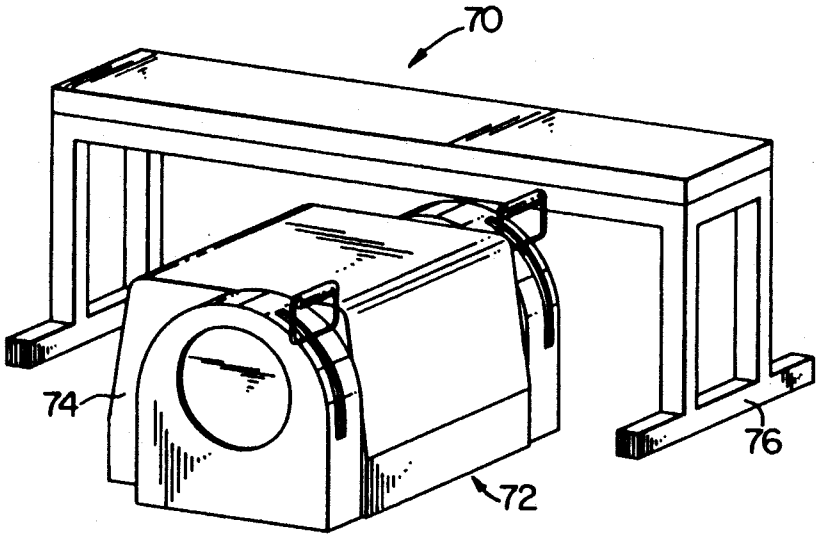
FIG. 7 is a perspective view of a modular exercise machine embodying the invention showing the separate base and bench units.
Figure 10:
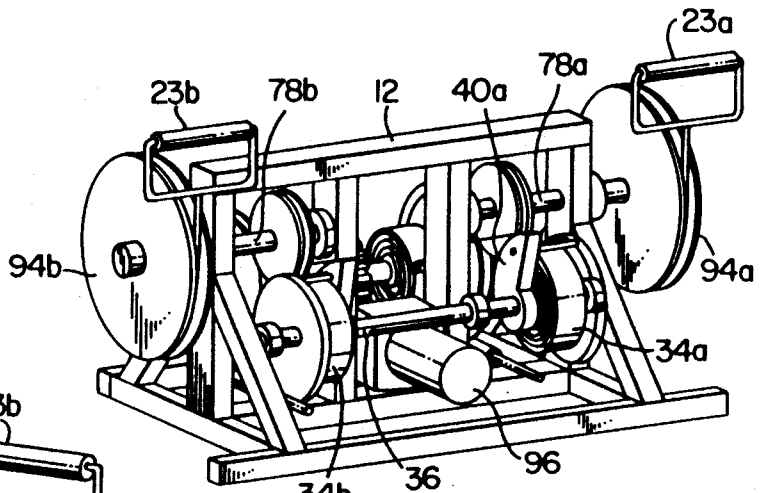
FIG. 10 is a somewhat reduced rear perspective view of the machine of FIGS. 7 and 8 shown with the housing removed.

Referring now to FIGS. 7–12, a modular exercise machine embodying the present invention and indicated generally at 70 has a base module, designated generally by the numeral 72, which includes a housing or cabinet 74 containing the machine operating mechanism, and a separate recline bench 76 for positioning relative to the base module 72. The illustrated machine 70 is particularly adapted to enable independent exercising of both sides of the body and has a pair of independently operable cables located at opposite sides of the base module 72, as will be hereinafter more fully discussed. In FIG. 8, the machine is shown setup for use in the performance of a bench press exercise with the recline bench 76 straddling the base module and with one end of the recline bench positioned adjacent the bench module, substantially as shown.

The machine 70 employs essentially the same operating principles discussed with respect to the previously described apparatus 10. More specifically, each of the two exercising cables which comprise the machine 70 is connected to an associated apparatus similar to the apparatus 10, previously described, the right hand half of the machine, as it appears in FIG. 9, being a substantial mirror image of the left hand half of the machine.

For convenience, in the further description which follows, parts of the machine 70 which generally correspond to parts of the previously described apparatus 10 bear the same reference numerals used in identifying the corresponding parts of the previously described mechanism. However, parts associated with the left-hand cable mechanism, as it appears in FIG. 9 include the letter a suffix, whereas parts of the machine 70 which form the right hand cable mechanism are further identified by the letter b suffix.

Figure 9:
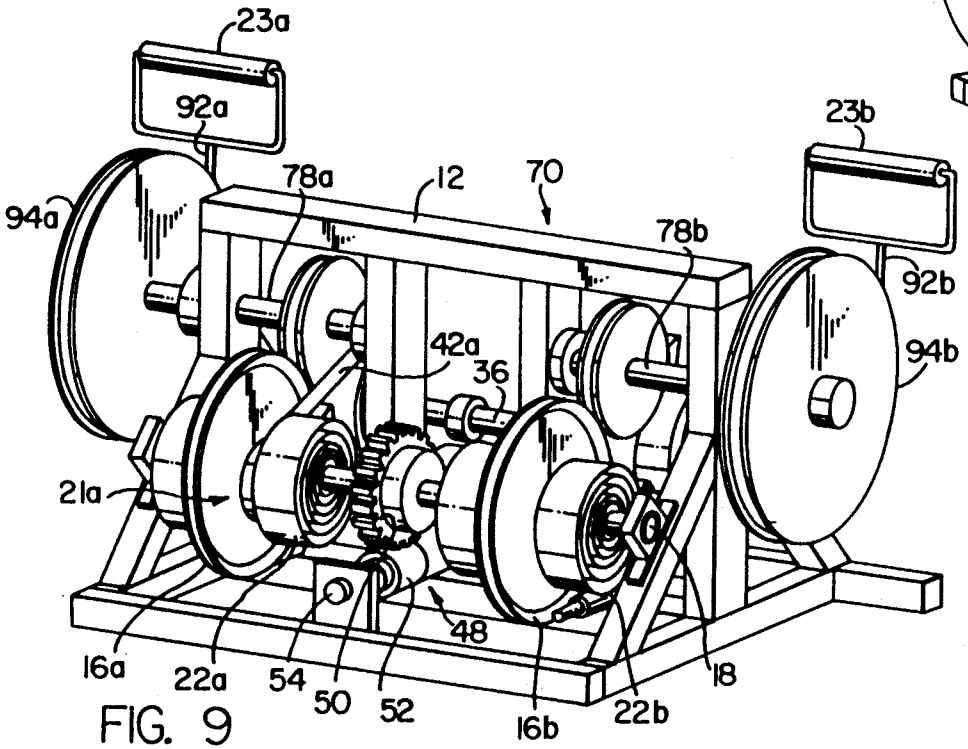
FIG. 9 is a front perspective view of the machine of FIGS. 7 and 8 shown with the housing removed.

Further referring to FIG. 9, the machine 70 has a frame 12 which provides journal support for a main shaft 18. A secondary shaft 36 mounted in fixed position on the frame extends transversely of the frame in parallel relation to the main shaft 18. However, unlike the previously described machine 10, the machine 70 also has a pair of output shafts **78*a* and 78*b* journalled for independent rotation and projecting outwardly from opposite sides of the frame 12**.

Figure 11:
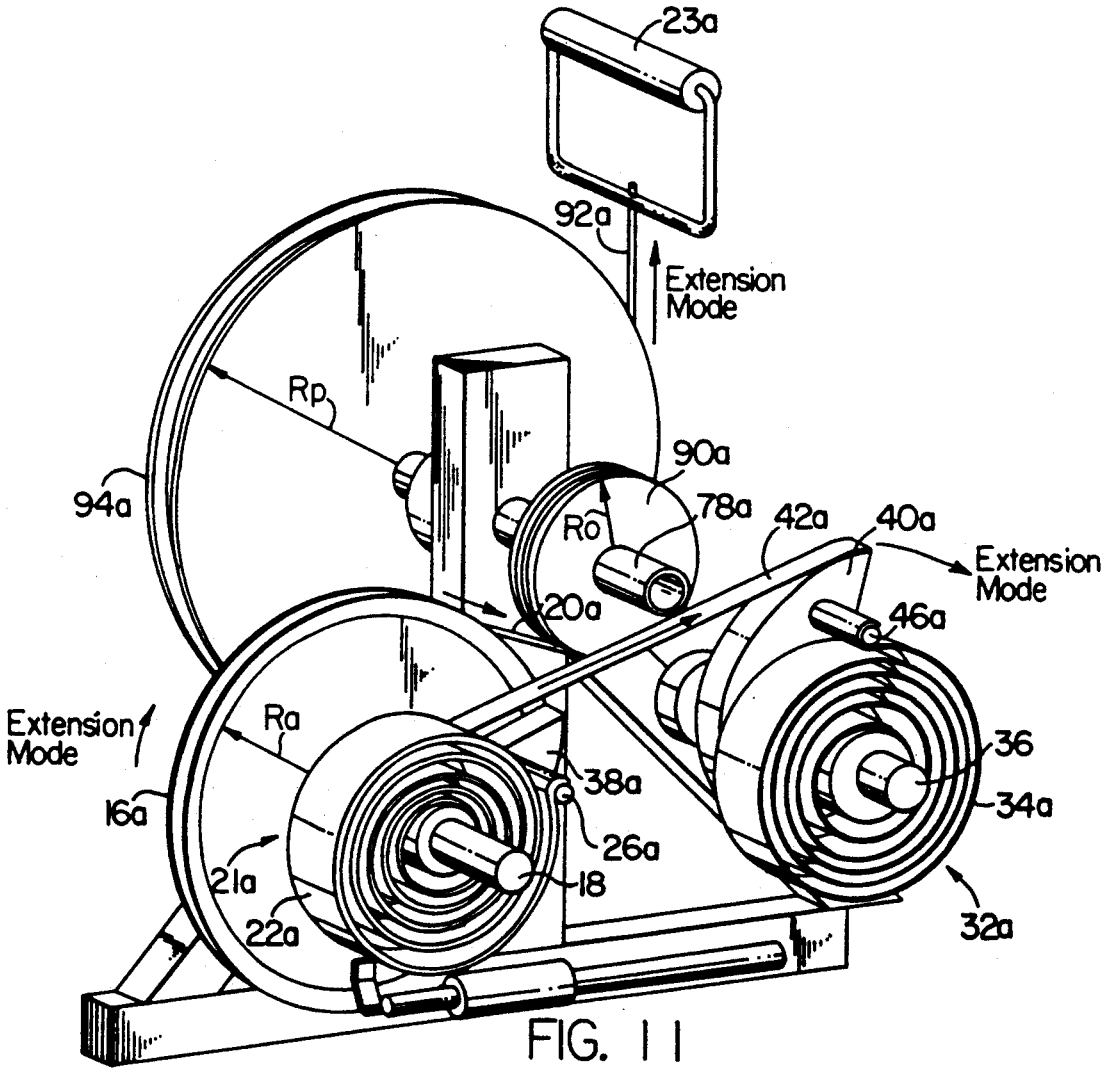
FIG. 11 is a somewhat further enlarged fragmentary perspective view of the left side of the machine, as shown in FIG. 9.

Referring now to FIG. 11, the left-hand cable mechanism is shown in somewhat more detail. The spring reaction mechanism **21*a* includes a main spring 22*a* of clock spring type. As in the previously described embodiment, the inner end of the main spring 22a is anchored in fixed position to the main shaft 18. A main spring cam 38a and a primary output reel 16a, both journalled for rotation on and relative to the main shaft 18, are connected to the outer end of the main spring 22a by a reverse loop formed in the outer end of the main spring and engaged by a unitizing pin 26a attached to the main spring cam 38a and the primary output reel 16a**.

The compensating mechanism 32a includes a compensating spring 34a the inner end of which is anchored in fixed position to the secondary shaft 36. The compensating mechanism further includes a compensating spring cam 40a journalled for free rotation on and relative to the secondary shaft 36 and connected to the outer end of the compensating spring 34a by a unitizing pin 46a. A flexible member or belt 42a connects the main spring cam 38a and the compensating spring cam 40a and operably engages the camming surface of these two cams.

As previously noted, the belt and belt cam assemblies which comprise the compensating mechanisms 32a and 32b impose some limitation on the degree of rotary motion of the rotational parts of the machine. To compensate for this limitation and allow for reasonable cable extension without the need for unduly large output reels a reduction drive mechanism is employed. This mechanism, best shown in FIG. 11 includes a secondary output reel 94a mounted in fixed position on the outboard end of the output shaft 78a and an intermediate drive reel 90a mounted in fixed position on the inboard end of the output shaft 78a. A secondary output cable 92a anchored at its inner end to the secondary output reel 94a is wound around the secondary output reel and has an output handle 23a at its outer or free end. The intermediate drive reel 90a is connected to the cable 20a wound on the primary output reel 16a. The size of the secondary output reel for a given cord extension is determined by the following formula:

$$RP=(Ro/Ra)\ EX/(2\pi.75)$$

Where

RP = Secondary Output Reel Radius

EX = Cable Extension

Ro = Intermediate Drive Reel Radius

Ra = A Primary Output Reel Radius

Further referring to FIG. 11, when a pulling force is applied to the handle 23a the secondary output reel 94a and the drive reel 90a rotate in unison in counterclockwise direction causing the primary output reel 16a to rotate in an opposite or clockwise direction to wind the main spring in clockwise direction. The cams 38a and 40a simultaneously rotate in clockwise direction causing a scheduled force to be transmitted through the belt 42a from the preloaded or prewound compensating spring which is wound in a clockwise direction about the secondary shaft 36.

As in the previously described embodiment a worm gear mechanism 48 (FIG. 9) restrains the main shaft 18 against independent rotation and prevents the main springs 22a and 22b from unwinding at the inner ends. Load adjustments are made by a user operated gear motor 96 (FIG. 10) which rotates the worm 52 fixed to the shaft 54. A momentary rocker switch, not shown, is provided in the motor wiring circuit to enable reversible operation to either increase or decrease the load setting. This gear motor replaces the handcrank 56 in the previously described device in FIG. 1.

The machine 70 also has a load sense/readout device 58a for detecting net load as the main springs are being wound and displaying this information to the user as an aid in setting the desired load. This device shown in FIG. 12 includes a stop bracket 28a fastened to the primary output reel 16a. The bracket engages a rod 100 which translates through mounting bracket 104 in response to net torque delivered to the stop bracket 28a. The rod 100 compresses load pick-up spring 102 of known spring constant allowing the determination of net delivered load from the measured displacement of the rod. This displacement can be detected by a rack and pinion gear assembly or other position sensing mechanisms generally indicated at 108 in FIG. 12 and displayed mechanically or electronically to the user by a device not shown. The spring loaded rod 100 also limits rotation of the output reel 16a and prevents unwinding of the main spring(s) at the outer end.

Since the load delivered by each of the secondary output reels 94a and 94b is substantially identical the load output at only one of the reels is sensed by the readout device. A suitable stop mechanism (not shown), preferably spring loaded, at the other or unsensed side of the machine holds the other output reel 16b at rest.

Figure 12:
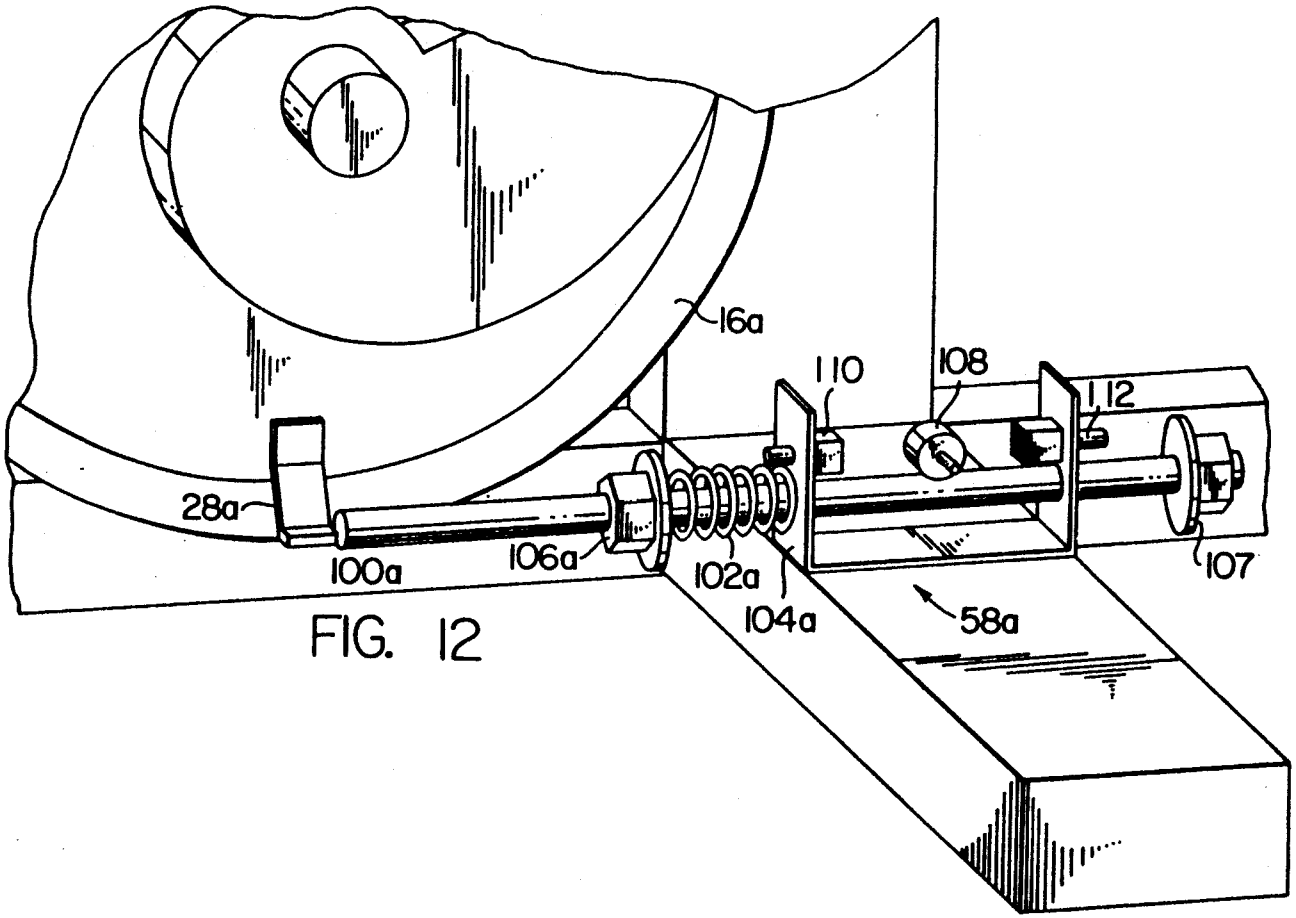
FIG. 12 is a diagrammatic view of the load readout device for the machine of FIGS. 7 and 8.
Figure 13:
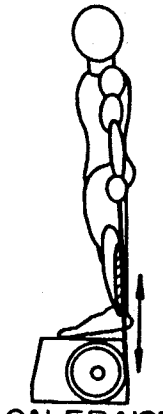
FIGS. 13–17 are somewhat diagrammatic side elevational views showing of the machine of FIGS. 7 and 8 set up for the performances of exercises in various body positions.
Figure 14:
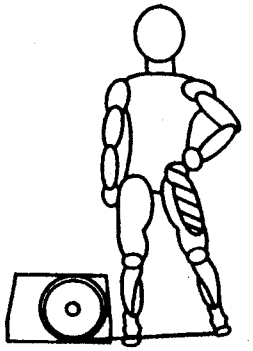
Figure 15:
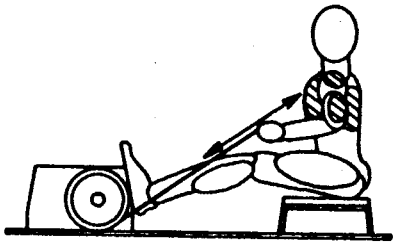
Figure 16:
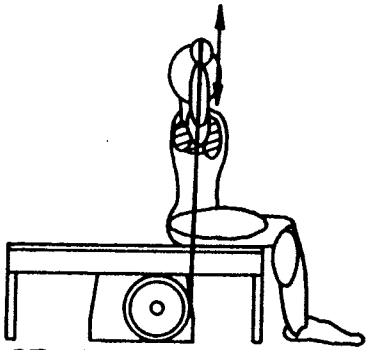
Figure 17:
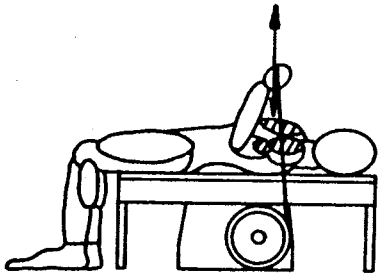

Preferably, and as shown in FIG. 12, normally closed limit switches are employed in the electrical circuit for the motor to disable the motor when a predetermined condition of load adjustment is attained. A high limit switch 110 prevents overtorquing of the drive motor 96 or the main spring by opening when engaged by flange when the maximum load output adjustment is attained. A low limit switch 112 operates in a similar manner to prevent backwinding of the main spring when the motor is operated in reverse direction to reduce the machine output load to its minimum load setting.

FIG. 13–17 illustrate various arrangements of the recline bench module 74 relative to and the base module 72 for the performance of exercises in seated, row, recline or standing positions.

It is presently estimated that a modular exercise machine, such as aforedescribed may be produced with a base unit weighing about 100 lbs. and an actual footprint of approximately 20×26 inches which should make the machine attractive to the home user having limited available floor space.

While the present invention has been illustrated and described with particular reference to machines adapted for use in the performance of physical workouts, it will be apparent that the mechanism hereinbefore described may be used where an adjustable spring reaction force of constant magnitude is required and such usage is contemplated within the scope of the present invention.

I claim:

1. In an exercise machine having at least one reel assembly including a reel supported for rotation about a reel axis, a flexible cable wound on the reel for rotating the reel in response to pulling input force applied to the cable, and reaction means including a reaction spring for applying to the reel reactive torque which changes in magnitude as the reel rotates, the machine having a cable extension mode wherein cable is payed-off the reel and a cable retraction mode wherein cable is wound onto the reel, the improvement comprising at least one spring compensating means connected to said one reel assembly for nullifying said changes in magnitude as said reel rotates including a preloaded compensating spring and coupling means connecting said compensating spring to said reel for applying compensating torque to said reel enabling rotation of said reel in response to pulling force of substantially constant magnitude applied to said cable.

2. In an exercise machine as set forth in claim 1 the further improvement wherein said coupling means comprises means for unloading said preloaded compensating spring when said machine is in said cable extension mode.

3. In an exercising machine as set forth in claim 1 the further improvement wherein said coupling means comprises camming means.

4. In an exercise machine as set forth in claim 3 the further improvement wherein said camming means comprises one cam connected to an associated one of said springs including said reaction spring and said compensating spring and connecting means for operably coupling said one cam to the other of said springs.

5. In an exercise machine as set forth in claim 4 the further improvement wherein said connecting means includes another cam connected to the other of said springs.

6. In an exercise machine as set forth in claim 5 the further improvement wherein said connecting means includes a flexible member operably connecting said one cam and said other cam.

7. In an exercise machine as set forth in claim 4 the further improvement wherein said reaction spring comprises a clock spring wound around one axis and said compensating spring comprises a clock spring wound around another axis parallel to said one axis.

8. In an exercise machine as set forth in claim 1 the further improvement wherein said coupling means comprises a pair of cams including one cam connected to said reaction spring and journaled for rotation about one axis and another cam connected to said compensating spring and journaled for rotation about another axis and a flexible member operably connecting said one cam to said other cam.

9. In an exercise machine as set forth in claim 8 the further improvement wherein said reel is connected to said one cam and said one axis comprises said reel axis.

10. In an exercise machine as set forth in claim 9 the further improvement wherein said reaction spring comprises a clock spring wound in one direction about said one axis.

11. In an exercise machine as set forth in claim 1 the further improvement comprising adjusting means for varying said reactive torque.

12. In an exercise machine as set forth in claim 11 the further improvement wherein said adjusting means comprises a worm gear mechanism.

13. In an exercise machine as set forth in claim 12 the further improvement wherein said adjusting means comprises drive means including a drive motor for operating said worm gear mechanism.

14. In an exercise machine as set forth in claim 13 the further improvement including limiting means for disabling said drive means in response to attainment of a predetermined condition of adjustment.

15. In an exercise machine as set forth in claim 1 wherein said machine includes another reel assembly and said one reel assembly and said other reel assembly have independently rotatable reels the further improvement including adjusting means for simultaneously adjusting said reactive torque associated with each of said reels.

16. In an exercise machine as set forth in claim 15 the further improvement wherein said adjusting means comprises a worm gear mechanism.

17. In an exercise machine as set forth in claim 1 the further improvement comprising load readout means for indicating the magnitude of said input force.

18. In an exercise machine as set forth in claim 17 the further improvement comprising stop means for limiting rotation of said reel.

19. In an exercise machine as set forth in claim 18 wherein said stop means comprises said load readout means.

20. A machine comprising a frame, an axially elongate main shaft journalled on the frame, means for restraining said main shaft against axial rotation relative to the frame, output means for operating said machine including an output member supported for rotation on and relative to the main shaft, a main spring spirally wound around said main shaft and having an inner end secured in fixed position to said main shaft and an outer end connected to said output means in radially outwardly spaced relation to the axis of said main shaft for applying to the output member torque which changes in magnitude as said output member rotates about said main shaft, and compensating means for nullifying said changes in magnitude and including a secondary shaft mounted in fixed position on said frame, a preloaded compensating spring spirally wound around said secondary shaft, said compensating spring having an inner end secured in fixed position to said secondary shaft and an outer end, and means for connecting said compensating spring to said output member including a compensating cam journalled for rotation on and relative to said secondary shaft said compensating spring outer end being connected to said compensating cam in radially outwardly spaced relation to the axis of said secondary shaft, a main cam journalled for rotation on and relative to said main shaft with said output member, and a flexible connecting member operably connecting said compensating cam to said main cam and maintained in tension by said compensating spring.

21. A machine as set forth in claim 20 further characterized as an exercise machine and wherein said output member comprises a reel and said output means includes a cable wound on said reel.

22. A machine having an output assembly including a rotary output member supported for rotation about an axis, input force means for causing rotation of said rotary output member about said axis, reaction means including a reaction spring for applying to the output member torque which changes in magnitude as the output member rotates, and compensating means for nullifying said changes in magnitude as said output member rotates including a preloaded compensating spring and coupling means connecting said compensating spring to said output assembly for applying compensating torque to said output member enabling rotation of said output member in response to input force of substantially constant magnitude applied to said input means.

* * * * *